US006115947A

United States Patent [19]

Swindle

[11] Patent Number: 6,115,947

[45] **Date of Patent: *Sep. 12, 2000**

[54] SHOE SYSTEM AND METHOD

[76] Inventor: Robert E. Swindle, 107 Marikesh, Daphne, Ala. 36526

[ * ] Notice: This patent is subject to a terminal disclaimer.

[21] Appl. No.: 09/335,951

[22] Filed: Jun. 18, 1999

Related U.S. Application Data

[63] Continuation of application No. 08/980,739, Dec. 1, 1997, Pat. No. 6,050,006.

[51] Int. Cl.[7] ..... A43B 5/00; A43C 15/00

[52] U.S. Cl. ..... 36/134; 36/67 R; 36/67 D

[58] Field of Search ..... 36/15, 67 R, 61, 36/36 R, 36 C, 42, 67 D, 134

[56] References Cited

U.S. PATENT DOCUMENTS

| | | | |
|---|---|---|---|
| 1,232,896 | 7/1917 | Clifford | 36/67 D |
| 1,618,881 | 2/1927 | Junker . | |
| 2,912,773 | 11/1959 | Boldt | 36/42 |
| 3,266,177 | 8/1966 | Holden | 36/36 R |
| 3,267,593 | 8/1966 | Turner | 36/67 D |
| 3,538,628 | 11/1970 | Einstein, Jr. | 36/15 |
| 3,672,077 | 6/1972 | Coles | 36/134 |
| 3,731,406 | 5/1973 | Young | 36/67 D |
| 5,025,576 | 6/1991 | Biasiotto et al. | 36/67 D |
| 5,259,129 | 11/1993 | Deacon et al. | 36/127 |
| 5,628,129 | 5/1997 | Kilgore et al. | 36/67 D |
| 5,768,809 | 6/1998 | Savoie | 36/67 D |

FOREIGN PATENT DOCUMENTS

| | | | |
|---|---|---|---|
| 1428358 | 12/1965 | France | 36/134 |
| 3046811 | 7/1982 | Germany | 36/134 |

OTHER PUBLICATIONS

Golf Digest '97, Soft Spikes advertisement, p. 149, printed Dec. 1996.

*Primary Examiner*—M. D. Patterson
*Attorney, Agent, or Firm*—Dennis W. Braswell

[57] ABSTRACT

A shoe system and a method of removing and attaching fixtures to shoes are provided in which a receptacle (14) includes an opening (16) through which a member (24) of a base (18) passes. The member (24) is rotated within the receptacle (14) and engages with a seat (34) to prevent unwanted rotation.

11 Claims, 3 Drawing Sheets

SHOE SYSTEM AND METHOD

CONTINUING APPLICATION INFORMATION

This application is a continuation patent application No. 08/980,739, filed Dec. 1, 1997, entitled Shoe System and Method, now U.S. Pat. No. 6,050,006.

TECHNICAL FIELD OF THE INVENTION

This invention relates generally to footwear, and in particular to a shoe system and a method of removing and attaching fixtures to shoes.

BACKGROUND OF THE INVENTION

A wide range of activities lend themselves to cleated footwear. Most such activities are sports or athletics related (for example, golf, football, baseball, mountain or pole climbing, and other sports), where stability and traction are important. In many instances, extending cleats provide better stability and traction then relatively smooth soles.

Although cleated footwear provides these obvious benefits, it also presents some drawbacks. For example, cleats wear out, and need to be replaced. Replacement is often difficult, expensive, and time consuming, since over time and use cleats often become stuck, due to, among other things, corrosion, rusting, and over tightening. Also, each cleat must be individually replaced, increasing the time needed for replacement. These problems are exemplified in the most common replaceable cleat: a cleat with a threaded shaft for threading engagement with a female socket embedded in the shoe sole.

Another problem with cleated footwear is that it is just that—cleated footwear. It cannot be readily converted for other uses, such as street or office uses. Many a golfer with an afternoon tee time would prefer to wear just one pair of shoes, easily adaptable from a relatively smooth sole for driving, walking, and working, to a cleated sole for golf.

While attempts have previously been made to overcome some of these problems, deficiencies in the various cleat designs have made them unsuccessful. For example, U.S. Pat. No. 3,731,406, issued to Young, and entitled "SPORT SHOE WITH QUICKLY REMOVABLE SPIKES," includes many individual spikes each with metal spring washer for holding the cleat, and requires a special tool for removing the cleats. U.S. Pat. No. 3,526,976, issued to Jacobs, and entitled "INTERCHANGEABLE SPORTS SHOE," provides bases with multiple cleats, but requires, for example, screws and a screwdriver to replace the bases. U.S. Pat. Nos. 2,607,135, 3,566,489, 4,035,934, and 3,267,593 include similar deficiencies.

Furthermore, the bottom soles of athletic or other shoes have provided a location for the manufacturer's logo on the sole. Sponsors can enjoy additional exposure if their logos are beamed to the TV audience as the athletes expose their shoe bottoms. However, there are no easy ways, if any, to change the information displayed on the shoe soles.

Also, the bottom sole (including the heel) of most every type of shoe often needs replacement or repair. Unfortunately, this is often an expensive and difficult task.

Therefore, a need has arisen for an improved shoe system and method of removing and attaching fixtures to shoes.

SUMMARY OF THE INVENTION

In accordance with the teachings of the present invention, a shoe system and method of removing and attaching fixtures to shoes are provided which eliminate or substantially reduce the problems associated with prior art systems.

In particular, a shoe is provided with an outer sole and a receptacle proximate the outer sole. The receptacle includes an opening. A base is provided that includes a member shaped to pass through the opening. Furthermore, a seat is located proximate the receptacle for engaging the member opposite the opening. In use, the member is rotated within the receptacle until it is misaligned with the opening. It is held in place by the engaging action of the seat, until rotated again for removal.

In a particular embodiment, the base includes a plurality of cleats.

In still another embodiment, the base includes graphic information.

In another embodiment, a shoe is provided with an outer sole and a receptacle proximate the outer sole. The receptacle includes an opening. A base is provided with a member shaped to pass through the opening and turn within the receptacle, and the base further includes a plurality of cleats. In another embodiment, the base includes graphic information.

Also, a shoe is provided with an outer sole and a receptacle proximate the outer sole. A base is provided for engaging with the receptacle, and the base includes graphic information. In a particular embodiment, the base includes a plurality of cleats.

A method of attaching a shoe fixture to the bottom of a shoe is also provided, which includes inserting a base through a matchingly shaped opening in a receptacle in a shoe, pressing the base against a resilient seat, and turning the base so that the base is misaligned with the opening.

An important technical advantage of the present invention is that it allows cleats to be quickly and easily removed, without the need to resort to specially adapted tools. In particular, cleats according to the present invention can be removed in less than a ¼ (90°) turn (although greater turns can be used with the present invention). This ability to insert and remove cleats with such a small turn is a significant advantage over cleats presently available. Similarly, because multiple cleats can be affixed to a single base, the time needed to replace cleats is substantially reduced.

Another technical advantage of the present invention is that it is substantially corrosion resistant, because of the materials from which it can be made.

Still another important advantage of the present invention is that it provides an efficient way for displaying and changing information on the bottom of a shoe.

BRIEF DESCRIPTION OF THE DRAWINGS

Reference is made in the description to the following briefly described drawings, wherein like reference numerals refer to corresponding elements.

DETAILED DESCRIPTION OF THE INVENTION

For directional reference, in the FIGURES, the upper of the shoe is above, or on top of, the outer sole of the shoe. Thus, as in normal usage, cleats extend downward.

Figure 1:
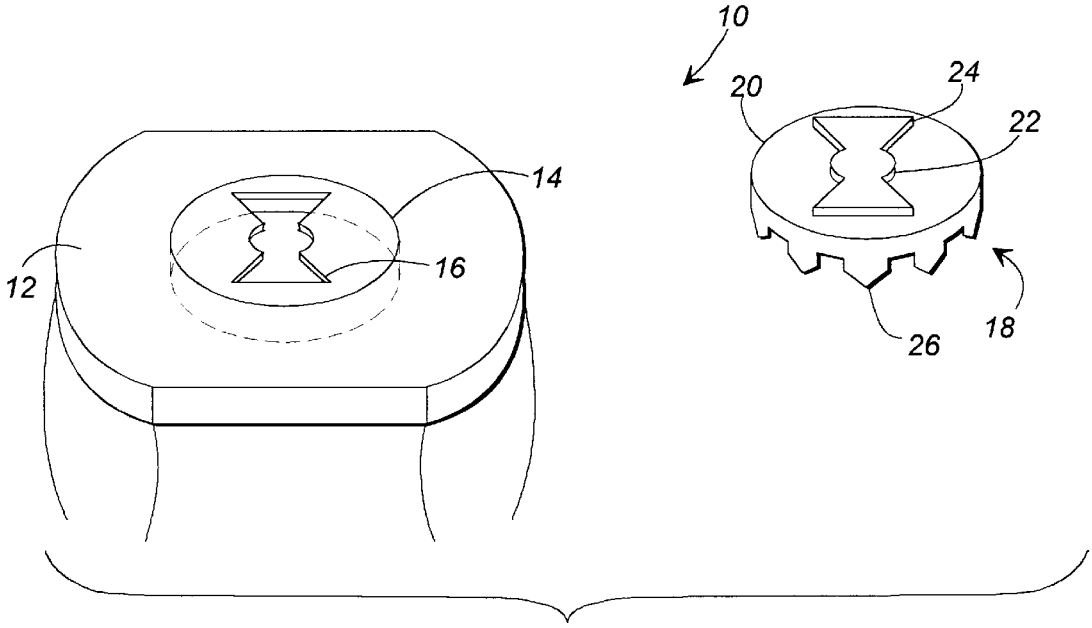
FIG. 1 is a perspective view of an unassembled shoe heel and cleat system according to one embodiment of the present invention.

FIG. 1 illustrates the heel portion of a shoe 10. Although the heel portion is illustrated, the teachings below apply as well to any part of the outer sole.

The shoe 10 includes an outer sole 12, which outer sole may be made of leather, rubber, plastic, composite materials, or any suitable sole material, and may be a separate piece attached to the shoe, or integrally formed with the shoe, or a combination. The outer sole refers generally to the bottom of the shoe. Embedded within the outer sole 12 is a female receptacle 14. Receptacle 14 includes an opening 16 for receiving a base 18.

Base 18 includes a platform 20 connected by a stem 22 to a male engaging member 24. Individual cleats 26 extend from the bottom of platform 20. As will be made clear from below, however, the platform 20 of base 18 need not include cleats (e.g., it can be relatively smooth) without departing from the teachings herein.

As can be seen in FIG. 1, opening 16 and member 24 are matchingly shaped, to form, in a sense, a keyway and key. The particular shape shown in FIG. 1 is illustrative only, and any other suitable shape may be used without departing from the intended scope of the present invention. By way of illustration only, and without limitation, the shape of opening 16 or member 24 may be oval, rectangular, star shaped, or irregularly shaped, among many other shapes. In a preferred embodiment, however, the shape is such to allow secure holding of base 18 with a minimum turning after the member 24 is inserted through opening 16.

In use, member 24 is inserted through opening 16, and then turned so that the member 24 and opening 16 are no longer aligned. As will be discussed in detail below, in the inside top of receptacle 14 is a seat that engages the top of member 24 and keeps it, and therefore base 18, from rotating after installation. With the embodiment shown in FIG. 1, the base is installed and removed in only a ¼ (90°) turn. As will be discussed, other designs can be inserted and removed in less than a ¼ turn.

Figure 2:
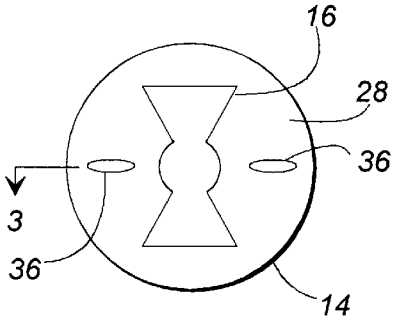
FIG. 2 is a bottom view of a receptacle element according to one embodiment of the present invention.
Figure 3:
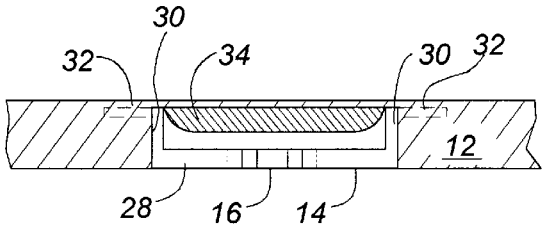
FIG. 3 is a sectional view of the section shown in FIG. 2.

FIGS. 2 and 3 show receptacle 14. Receptacle 14 includes opening 16 in a bottom wall 28. Bottom wall 28 is coupled to sidewall 30. Although receptacle 14 is illustrated as round, it may be of any suitable shape or size without departing from the intended scope herein. Furthermore, the receptacle 14 (and base 18) may be contoured to conform to the contour of the shoe and sole for which it is intended. Receptacle 14 is preferably affixed to shoe sole 12 and, if necessary shoe 12, by a glue, such as epoxy, industrial glue, or other adhesive. However, it may be secured between the outer sole 12 and the shoe 10 by an optional flange 32, or with any other fastener or fastening mechanism or bonding or welding technique. Furthermore, one or more other layers can be inserted, if desired, above the receptacle, so as to cushion the foot.

Receptacle 14 may be made of plastic, metal, Teflon, delrin, polyethylene, rubber, composites, or other suitable material, and is preferably formed through a molding process. However, other materials and manufacturing techniques (such as machining, among other techniques) may be used as well.

At the top of receptacle 14, and secured to the shoe 10 (or sole 12 if the sole is thick enough), is a seat 34. Seat 34 is secured, for example, with a glue, such as epoxy, industrial glue, or other adhesive. However, any fastener or fastening mechanism may also be used without departing from the teachings herein. Furthermore, receptacle 14 may be provided with a top wall affixed to the shoe 10 (or sole 12 if the sole is thick enough), and the seat 34 would then be affixed to the bottom of that top wall.

This seat 34, as described above, engages the top of member 24 to keep it from rotating, and can also provide firmness and support. This engaging action occurs because of the resilient (e.g., deformable) property of seat 34, which is preferably made of resilient rubber, such as EPDM, as well as the relative sizes of the parts, to be discussed below. It should be understood, however, that any material or device capable of engaging the member 14 could be used for seat 34 without departing from the intended scope herein. Indeed, if the tolerances are correct, no separately added seat 34 is needed, and its function can be served by the bottom of the shoe, or by the sole if it is thick enough to accommodate the receptacle 14, or a top wall of receptacle 14. In such case the bottom of the shoe, the sole, or the top wall is referred to as the seat.

When the member 24 is first inserted into the receptacle 14, it is pushed against the seat 34 to cause seat 34 to compress, then rotated. After member 24 is appropriately rotated, resilient seat 34 engages member 24 to prevent it from rotating. This process is reversed when removing the base 18.

Also shown in FIG. 2 are optional grooves 36 on the bottom of the bottom wall 28 of receptacle 14. These grooves receive locking bumps 38 shown in FIG. 4. These grooves and bumps provide a locking mechanism to assist in preventing unwanted rotation of the base 18, and provide a locating feel for the user to indicate when to stop turning the base during replacement. Furthermore, these grooves and bumps can be reversed, such that the bumps are on the bottom wall 28, and the grooves are on the platform 20. Furthermore, other locking mechanisms can also be used. For example, a ramp can be formed on the upper (inside) surface of bottom wall 28 to lock member 18 after it has been turned the appropriate amount. As another example, grooves and bumps, as discussed above in relation to the top of platform 20 and the bottom of bottom wall 28, can be used on the bottom of member 24 and the top of bottom wall 28. It should be understood, however, that no such locking mechanism is needed.

Figure 4A:
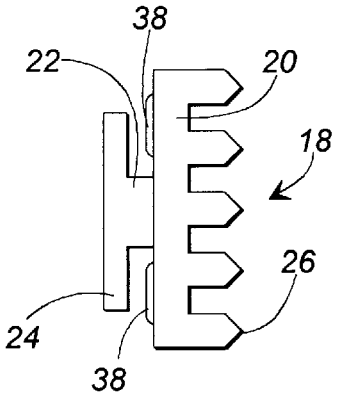
FIG. 4*a* is a side view of a cleat base according to one embodiment of the present invention.

FIG. 4*a* is a side view of base 18, and illustrates the platform 20, stem 22, member 24, cleats 26, and bumps 38. Base 18 is made of any suitable material, such as metal, plastic, Teflon, delrin, polyethylene, rubber, or composites, among others, and is preferably made by a molding process, although other materials and manufacturing processes can be used. Cleats 26 can be made integrally with base 18, or can be separately affixed. Cleats 26 can be of any suitable material, including, among others, plastic, rubber, ceramic, or metal, and can be integrally formed with or affixed to platform 20 by any suitable fastener, including glues, epoxies, threads, or other fastening mechanisms or materials, or by bonding or welding. The shape of the cleats can be varied to suit any desired application, and for example can be shaped as traditional spikes, or as ribs, pyramids, bumps, or other shapes. The term cleat herein is used in a very broad sense, to include any projecting surface feature. Also, although the platform 20 is shown as round, it can be otherwise shaped and sized as desired.

Figure 4B:
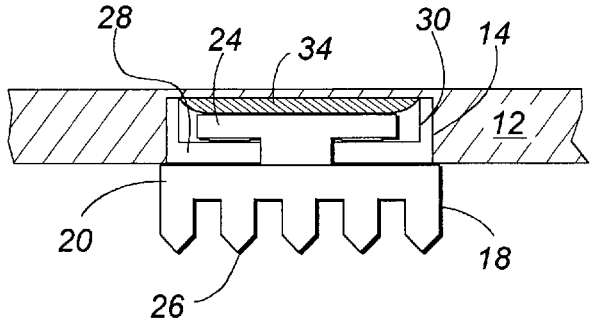
FIG. 4*b* is a sectional view of a cleat base inserted in a receptacle element.

FIG. 4*b* illustrates a sectional side view of base 18 inserted within receptacle 14. In a preferred embodiment, the depth of member 24 is just deeper than the space between seat 34 and bottom wall 28. This assures that the seat 34 is compressed against the member 24 to prevent unwanted rotation.

Figure 5:
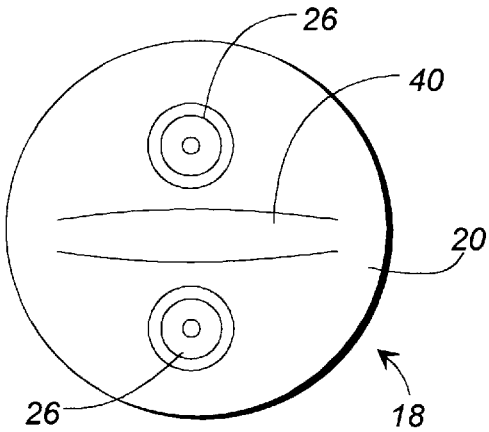
FIG. 5 is a bottom view of a cleat base according to one embodiment of the present invention.
Figure 6:
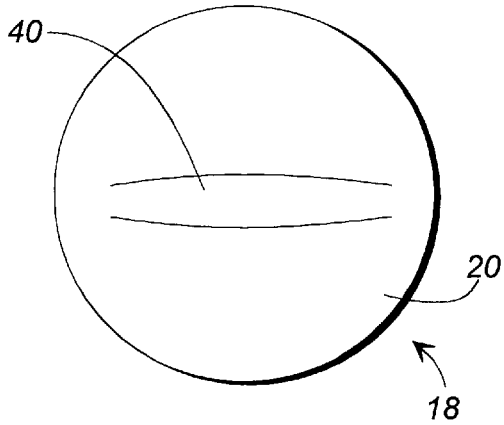
FIG. 6 is a bottom view of a cleat base according to another embodiment of the present invention.

FIGS. 5 and 6 are bottom views of the base 18. FIG. 5 shows an embodiment with two cleats 26, it being understood, however, that more or less cleats could be used, in most any configuration. Furthermore, the round shape of platform 20 is exemplary only, and could be any shape. FIG. 6 shows a cleatless platform 20, which may be used when cleats are not needed, for example when the shoes are to be used for walking, driving, or office work. With the cleatless base, it may be desirable to form the base from rubber, or to cover it with rubber or leather or other suitable material. It should be understood that these platforms can have most any outward appearance or shape, accommodating, for example, cleats, smooth surfaces, grooves, traction patterns, pyramids, bumps, or any shape or surface.

Both FIGS. 5 and 6 show a groove 40 adapted to receive a turning implement, which may be a coin or screwdriver. Such an implement is useful in turning the base 18 during installation and removal. However, no implement is necessary to turn the base 18.

Figure 7:
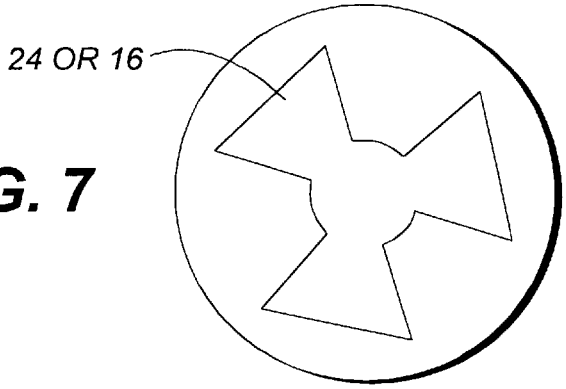
FIG. 7 is a top view of a cleat base or bottom view of a receptacle element according to one embodiment of the present invention.

FIG. 7 illustrates an alternative design of member 24 and opening 16. With this embodiment, only a ⅙ (60°) turn is needed for insertion and removal.

Figure 8:
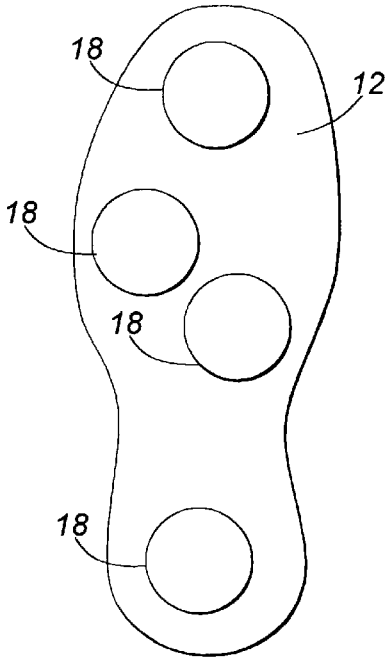
FIG. 8 is bottom view of a shoe with a cleat system according to one embodiment of the present invention.
Figure 9:
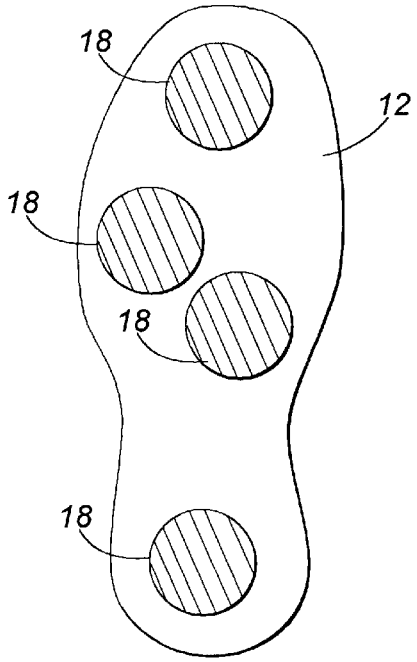
FIG. 9 is bottom view of a shoe with a cleat system according to another embodiment of the present invention.

FIGS. 8 and 9 show possible locations of bases 18 on shoes. These placements, however, are exemplary only, and many other placements can be used. As these FIGURES make clear, the present invention, because it allows multiple cleats on a single base, allows for a whole set of cleats to be replaced with only a few removals and inserts. FIG. 9 shows a particular pattern of grooves. It should be understood that many different bases can be interchanged in a single shoe, thus allowing the shoe to be used in many different applications.

Figure 10:
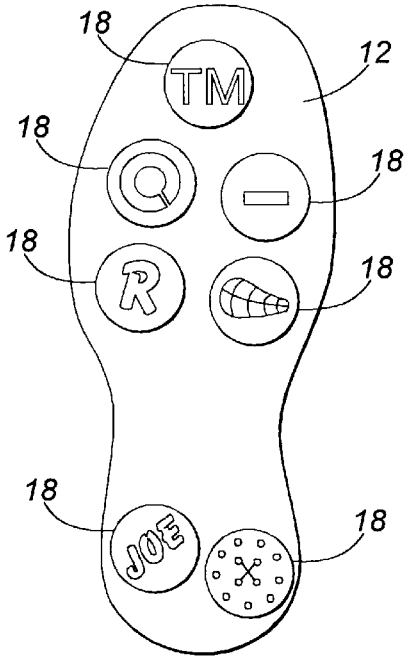
FIG. 10 is bottom view of a shoe with a cleat system with information displayed according to one embodiment of the present invention.

FIG. 10 illustrates another embodiment of the present invention for displaying information, such as marketing, sales, promotional, or other information on the sole of a shoe. In particular, the messages, letters, symbols, logos, names, colors, or other information, generally referred to as graphic information, are affixed, printed, painted, or otherwise connected to the bottom of the platforms 20 of bases 18 (which may or may not include cleats). Furthermore, because of the ease of changing out the bases, this information can be easily changed.

Figure 11:
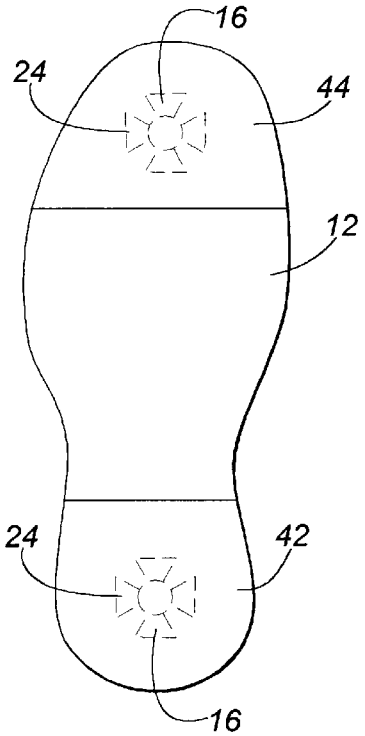
FIG. 11 is a bottom view of another embodiment of the present invention

FIG. 11 shows another embodiment of the present invention, illustrating how the present invention can be used to attach most any shaped fixture for most any function to a shoe. As shown in the particular example, the base 18 may form the entire heel of the shoe. Of course, the base could form part of the heel or a section of the sole, for example for replacing worn out sections.

In summary, an improved shoe system and method of removing and attaching fixtures (such as bases for cleats, graphics, heels, sole sections, or other fixtures) to shoes have been provided. These allow for quick and easy replacement of, among other fixtures, cleats by placing a plurality of cleats on a single base and by providing for insertion and removal of the base in no more than a ¼ turn (although, if desirable, greater turns can be used with the present invention) without the need for any turning implement. Indeed, any fixture, including shoe heels and sole sections can be removed and replaced with the present invention. Furthermore, information, such as marketing information, can be readily changed on the sole of a shoe by placing such information on the bases according to the present invention.

Although the present invention has been described in detail, it should be understood that various changes, alterations, substitutions, additions, and modifications can be made without departing from the intended scope of the invention, as defined in the following claims.

What is claimed is:

1. A shoe, comprising:

an outer sole;

a receptacle proximate the outer sole, the receptacle including an opening providing access to a void;

a base including a member shaped to pass through the receptacle opening into the void, the void shaped to allow the member to turn within the void from a position aligned with the receptacle opening to a position misaligned with the receptacle opening; and a seat inside and at the top of the receptacle, the seat exerting a downward force on the member.

2. The shoe of claim 1, wherein the opening and the member are matchingly shaped.

3. The shoe of claim 1, wherein the base includes a plurality of cleats.

4. The shoe of claim 1, wherein the base includes graphic information.

5. The shoe of claim 1, wherein the seat is at least in part made of rubber.

6. The shoe of claim 1, wherein the base includes graphic information.

7. A shoe attachment, comprising:

a receptacle including an opening providing access to a void;

a base including a member shaped to pass through the receptacle opening into the void, the void shaped to allow the member to turn within the void from a position aligned with the receptacle opening to a position misaligned with the receptacle opening, the base including graphic information, and a seat inside the receptacle exerting a downward force on the member.

8. The shoe of claim 7, wherein the base includes a plurality of cleats.

9. A method of attaching a shoe fixture to the bottom of a shoe, comprising:

inserting a base through a matchingly shaped opening in a receptacle in a shoe;

pressing the base against a seat located inside and at the top of the receptacle, the seat exerting a downward force on the member; and turning the base so that the base is misaligned with the opening.

10. The method of claim 9, and further comprising displaying graphic information on an outside surface of the base.

11. The method of claim 9, and further comprising displaying graphic information on an outside surface of the base, the graphic information comprising one or more logos, characters, letters, words, phrases, designs, symbols, or images.

* * * * *